US005864349A

United States Patent [19]

Hirabayashi et al.

[11] Patent Number: 5,864,349

[45] Date of Patent: Jan. 26, 1999

[54] RECORDING APPARATUS WITH PLURAL HEADS

[75] Inventors: Hiromitsu Hirabayashi; Tsuneki Inuzuka, both of Yokohama; Fumihiro Gotoh; Akitoshi Yamada, both of Kawasaki, all of Japan

[73] Assignee: Canon Kabushiki Kaisha, Tokyo, Japan

[21] Appl. No.: 593,339

[22] Filed: Jan. 29, 1996

[30] Foreign Application Priority Data

Jan. 31, 1995 [JP] Japan ..... 7-013883

[51] Int. Cl.[6] ..... B41J 23/00

[52] U.S. Cl. ..... 347/39

[58] Field of Search ..... 347/20, 37, 39

[56] References Cited

U.S. PATENT DOCUMENTS

| | | | |
|---|---|---|---|
| 3,689,693 | 9/1972 | Cahill et al. | 358/470 |
| 4,272,771 | 6/1981 | Furukawa | 346/75 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 5,151,716 | 9/1992 | Kanemitsu | 347/42 |
| 5,359,355 | 10/1994 | Nagoshi et al. | 347/9 |
| 5,371,531 | 12/1994 | Rezanka et al. | 347/43 |
| 5,402,161 | 3/1995 | Kimura et al. | 347/37 |
| 5,416,395 | 5/1995 | Hiramatsu et al. | 318/600 |
| 5,448,274 | 9/1995 | Hirabayashi et al. | 347/86 |
| 5,477,248 | 12/1995 | Sugimoto et al. | 347/43 |
| 5,500,661 | 3/1996 | Matsubara et al. | 347/41 |
| 5,502,464 | 3/1996 | Takahashi et al. | 346/25 |
| 5,617,122 | 4/1997 | Numata et al. | 347/14 |

FOREIGN PATENT DOCUMENTS

| | | |
|---|---|---|
| 145025 | 6/1985 | European Pat. Off. . |
| 391730 | 10/1990 | European Pat. Off. . |
| 50-81437 | 7/1975 | Japan . |
| 54-56847 | 5/1979 | Japan . |
| 59-123670 | 7/1984 | Japan . |
| 59-138461 | 8/1984 | Japan . |
| 60-71260 | 4/1985 | Japan . |
| 60-99679 | 6/1985 | Japan . |
| 61-27269 | 2/1986 | Japan . |
| 56-56889 | 5/1991 | Japan . |
| 5-124192 | 5/1993 | Japan . |
| 909050 | 10/1962 | United Kingdom . |

*Primary Examiner*—Adolf Berhane
*Attorney, Agent, or Firm*—Fitzpatrick, Cella, Harper & Scinto

[57] ABSTRACT

A shuttle type recording apparatus having a plural recording heads spaced apart on a common carriage that is mounted to scan over an entire recording area for recording, respectively, in each of plural divided recording areas of the entire recording area. A rail element is mounted on the carriage and extends along the direction of scanning. A drive element is arranged to drive the carriage via the rail element, and a connection portion for transferring driving forces from the drive element to the rail element is provided in the region of the central part of the recording area.

37 Claims, 15 Drawing Sheets

RECORDING APPARATUS WITH PLURAL HEADS

BACKGROUND OF THE INVENTION

1. Field of the Invention

This invention relates to a serial scanning type recording apparatus which produces a high quality image on a recording medium, such as a paper sheet, by means of a moveable recording carriage which faces and scans across the surface of a recording medium. More specifically, this invention relates to a shuttle type recording apparatus in which plural recording heads are mounted in spaced apart relation on a moveable recording carriage and which permits recording at high speed and with high accuracy. This invention is especially advantageous for the recording of images by the transfer of a color agent onto a recording medium based on image data; and it is suitable still more in connection with ink jet recording wherein a liquid recording ink is discharged as a color agent onto a recording medium. This invention, moreover, may be used for recording on many different recording media, for example, paper, cloth, leather, nontextile materials, overhead projector films and metal. One specific application for this invention is in a business machine such as a printer, a copy machine or a facsimile machine, as well as a manufacturing machine such as a textile printing machine.

2. Description of the Related Art

Serial scanning type recording devices which record by causing a recording head to scan across the surface of a recording medium while transferring an image to the recording medium have been widely used. Such devices are less costly than devices which record by means of a stationary recording head which extends over the whole width of a recording area.

A number of different serial scanning type recording devices, in which a color agent is transferred to a recording material, have been put into practice or proposed. These include devices in which a color agent is made to appear by the application of heat from a thermal head onto special thermal sensitive paper or by application of light onto a special light sensitive paper.

Moreover, devices which record by transferring a color agent from a recording head onto recording medium by a recording head, have been put into practice or have been proposed. These include impact recording devices which transfer ink onto a recording medium by impacting, with printing wires, an ink ribbon which has been soaked with liquid ink as a color agent. These color agent transfer devices also include thermal melt devices which record by application of heat from a thermal head onto an ink ribbon which contains a solid color agent. Heat sublimation transfer devices and ink jet devices which record by discharging liquid record ink onto a recording medium are also known.

Recently, color agent transfer recording devices have become widely used for recording onto plain paper. In particular, ink jet type recording devices are finding increasing use; and are expected to be used even more widely in the future in connection with printers, copy machines and other business machines because of their low noise, low running cost, ease of miniaturization, the possibility of plain paper recording, the ease of colorizing and so on.

Since the above described serial scanning type recording devices use a recording head which is mounted on a moveable carriage, a problem arises in that the recording speed is low.

Some of the techniques that have been proposed or put into practice in order to improve the recording speed of a serial scanning type image recording apparatus include: decreasing the number of scans by providing a wider recording head; shortening the scanning time by increasing the scanning frequency; and recording by bidirectional scanning. However, each of these techniques has disadvantages.

For example, a wider recording head is expensive to manufacture; and a wide recording head requires an expensive, high storage capacity print buffer. Also, where the device uses heat to effect a color agent transfer, some means must be provided to prevent deterioration of record quality and damage to the recording head from the high temperature used in the process. Further, in ink jet recording, where the recording head does not touch the recording medium, some means must be provided to prevent deterioration of recording quality which is caused by rolling or cockling of the recording medium as it becomes permeated with liquid ink.

When the scanning speed of the carriage is increased in order to increase recording speed, the carriage drive load is increased and a larger drive source is required.

Devices which use heat to transfer a color agent transfer onto a recording medium require some means to prevent deterioration of recording quality and damage to the recording head due to the high temperature of the recording head itself. In addition, ink jet recording devices which use liquid ink experience ink vibration within the recording head during ink discharge; and this causes deterioration of the recording quality.

Japanese Patent Laid-Open Publication No. 50-81437, U.S. Pat. No. 4,272,771, discloses methods and apparatus for increasing the recording speed of a serial scanning type image recording apparatus. As disclosed in that publication, a dot matrix high speed impact printer is provided with a plurality of printing heads which operate simultaneously to print each line of print. Also, in order to eliminate the delay caused by carriage return, the printing heads operate irrespectively of the direction in which the printing heads move. The dot matrix high speed impact printer disclosed in the above mentioned publication produces a "half step dotted" pattern row, which provides a significantly improved print quality. Also, the printer described in that publication uses a simple and highly reliable mechanical drive apparatus to move the printing head assembly accurately and rapidly.

The method and apparatus disclosed in the above mentioned publication permits simultaneous printing on both the left half and the right half of a printing line. In this case separate left side and right side printing head assemblies are supported on the same carriage mechanism. This arrangement allows printing to be carried out at almost double speed. The printing speed can be increased even more by providing more than two printing head assemblies and by operating the printing heads in both directions of movement. The above mentioned publication also discloses an arrangement for precise control of the movement and positioning of the printing head assembly. According to this arrangement a thin board is installed on the printer body and a light detector is installed on the printer head assembly. The thin board has transparent narrow slits arranged at roughly equal intervals therealong. Each slit corresponds to a row of print; and the slits have a length equal to about one half of the length of a print line.

The printing head carriage in the above described device is driven via a closed loop timing belt which in turn is driven by a motor. This arrangement provides adequate printing accuracy where a pixel density matrix of about 9×7 is to be used. However, where high resolution and high speed are needed, a problem arises due to expansion and contraction of the timing belt due to load variations on the belt as the printing head carriage is driven at different speeds. This problem is especially severe where several recording heads are mounted on the same carriage. This is because the additional heads, and the additional ink that must be supplied to these heads, increases the overall weight of the carriage; and consequently increases the load on the belt as scanning speed varies. Also, where the recording apparatus uses a recording head with a plural recording elements which are operated according to a time division sequence, the resulting variation in scanning speed causes a drastic effect on image quality. This is especially severe in ink jet recording apparatus which use a liquid ink and a recording head which does not touch the recording medium.

A further problem which occurs in the use of ink jet recording devices with plural recording heads is that some of the ink which is projected from ink discharge orifices on the printing head rebounds from the recording medium in the form of a mist and accumulates back on the recording head in the vicinity of the discharge orifices. As a result, ink jet recording systems generally require a recovery means to remove this accumulation. One technique that has been adopted is to provide a wiper blade of an elastic material, such as gum, to wipe the surface of the discharge orifice and remove this ink accumulation. Also, to prevent ink within the discharge nozzle of a recording head from evaporating and drying, a cap is arranged to cover the recording head during non-recording intervals. In addition, a suction pump may be provided in connection with the cap to maintain the flow of ink during non-recording intervals so that it does not experience an increase in viscosity. The suction pump may be arranged so as to recover the extra ink.

In some ink jet recording devices, which operate on an on-demand basis, not all of the several discharge orifices are in use at the same time; and some of the orifices may not be use for a considerable length of time, particularly in the case of color recording devices where one color may used for only a small portion of the printing. Also, in a plural head color recording device, one recording head may not be used for a long period of time, depending on the recording instructions and data supplied to it. Now, when the carriage scans or stops in a position where the surface of the ink discharge orifice is not capped, the ink within and surrounding the orifice begins to dry and causes a deterioration in the quality of the subsequently recorded image. In order to prevent this phenomenon in an ink jet recording device, an arrangement is provided to cause a discharge of ink at some predetermined location and time which is unrelated to the actual recording. This kind of ink discharge action is called a preliminary discharge. By maintaining the discharge of ink from within the discharge orifice, fresh ink is always available for recording and high quality recording can be maintained. In order to keep the preliminary discharge ink from scattering and dirtying the recording material and the inside of a recording apparatus, the preliminary discharge is generally arranged to occur within the cap while it covers the head at a preliminary discharge position of the head. The provision of means for maintaining the cleanliness of plural recording heads in ink jet recording devices severely complicates the construction of the heads.

SUMMARY OF THE INVENTION

It is an object of the invention to provide a recording apparatus that can record an image at high speed by using plural recording heads, and that at the same time can record an image with high accuracy by making use of novel structural characteristics of the plural heads.

Another object of the invention is to provide a recording apparatus that minimizes deterioration of printing accuracy due to increased carriage weight and speed variation when recording is carried out on a time divisional basis and when a color agent is carried along in a printing head carriage.

A further object of the invention is to provide, in an ink jet recording device having two or more printing heads, a simplified arrangement for maintaining the proper flow of ink from the heads.

A still further object of the invention is to provide a recording device which overcomes the problem caused by the antiethical relation of the small scanning space available for the carriage and the color agent storage capacity of the carriage, particularly where the device uses plural recording heads and where the color agent is maintained in the carriage.

According to one aspect of the invention there is provided a moveable scanning element which faces toward a recording medium and which is constructed to support plural recording heads spaced apart in a predetermined interval to record, respectively, on corresponding divided recording areas of an entire recording area, along a scanning direction of the moveable scanning element. A rail element is arranged on the moveable scanning element along its scanning direction. The length of the rail element corresponds to a scanning distance needed for recording over the entire recording area. A drive element is provided for driving the moveable scanning element via the rail element to cause said moveable scanning element to scan. A connection portion is arranged in the region of the central part of a scanning area of the moveable scanning element to couple the drive element to the rail element.

According to another aspect of the invention there is provided a carriage which moves back and forth along a support to provide a scan which extends over a recording area. The carriage is constructed to support at least two recording heads so that they are spaced apart on the carriage in the direction of the scan, whereby as the carriage moves to scan the recording area, each recording head passes over a different part of the recording area. A drive rail extends along the carriage in the direction of the scan. There is also provided a driver for moving the carriage, as well as a drive connection which transfers driving force from the driver to the rail at a location within the range of scanning movement of the carriage.

According to a further aspect of the invention there is provided a carriage which moves back and forth along a support to provide a scan which extends over a recording area. The carriage is constructed such that at least two recording heads which are spaced apart on the carriage in the direction of the scan, each passes over a different part of the recording area as the carriage moves to scan the recording area. A drive rail extends along the carriage in the direction of the scan. There is also provided a driver for moving the carriage, as well as a drive connection which transfers driving force from the driver to the rail. The driver is arranged to drive the carriage by an amount greater than the distance between at least recording heads thereon so that in the course of a scan the two recording heads pass over the same overlap portion of the recording area.

According to a still further aspect of the invention there is provided moveable scanning element which faces toward a recording medium and which supports plural recording heads spaced apart in a predetermined interval to record, respectively, on corresponding divided recording areas of an entire recording area, along a scanning direction of the moveable scanning element. A rail element is arranged on the moveable scanning element along its scanning direction. The length of the rail element corresponds to a scanning distance needed for recording over the entire recording area. A drive element is provided for driving the moveable scanning element via the rail element to cause said moveable scanning element to scan. The drive element is arranged to drive the carriage by an amount greater than the distance between at least two recording heads thereon so that in the course of a scan the two recording heads pass over the same overlap portion of the recording area. Servicing means are for acting on, and enabling proper transfer of a color agent by, said recording heads are located in the overlap portion of the recording area in order to permit servicing of the plural recording heads in common.

According to yet another aspect of the invention there is provided a moveable scanning element which faces toward a recording medium and which supports plural recording heads spaced apart in a predetermined interval to record, respectively, on corresponding divided recording areas of an entire recording area, along a scanning direction of the moveable scanning element. A rail element is arranged on the moveable scanning element along its scanning direction. The length of the rail element corresponds to a scanning distance needed for recording over the entire recording area. A drive element is provided for driving the moveable scanning element via the rail element to cause said moveable scanning element to scan; and a color agent element is provided on the moveable scanning element between the plural recording heads to supply the color agent to the plural recording heads in common.

DETAILED DESCRIPTION OF THE PREFERRED EMBODIMENTS

Preferred embodiments of the present invention will now be described with reference to the drawings in detail.

Figure 1:
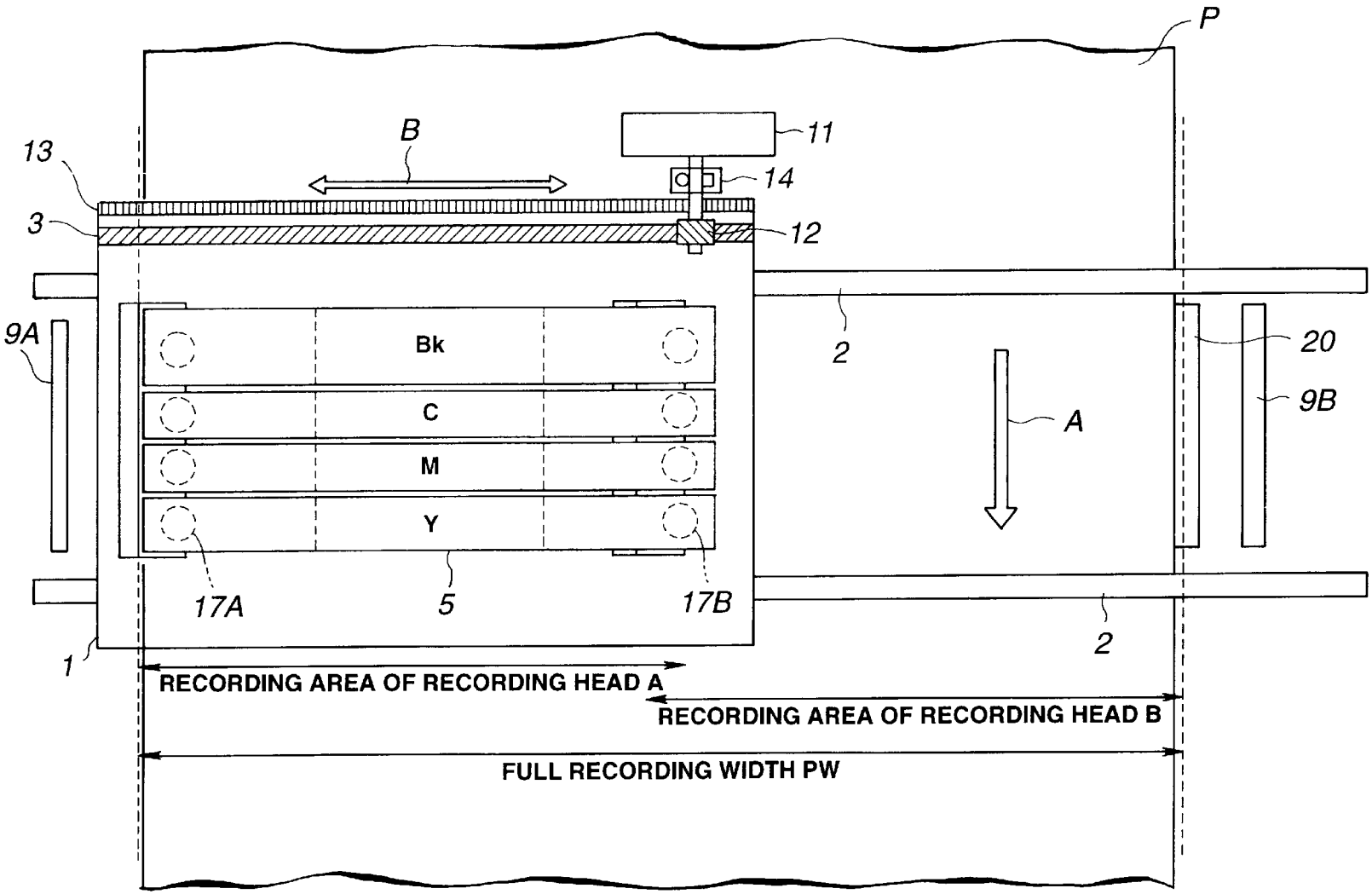
FIG. 1 is a top plan view of a recording apparatus according to a first embodiment of the present invention.
Figure 2:
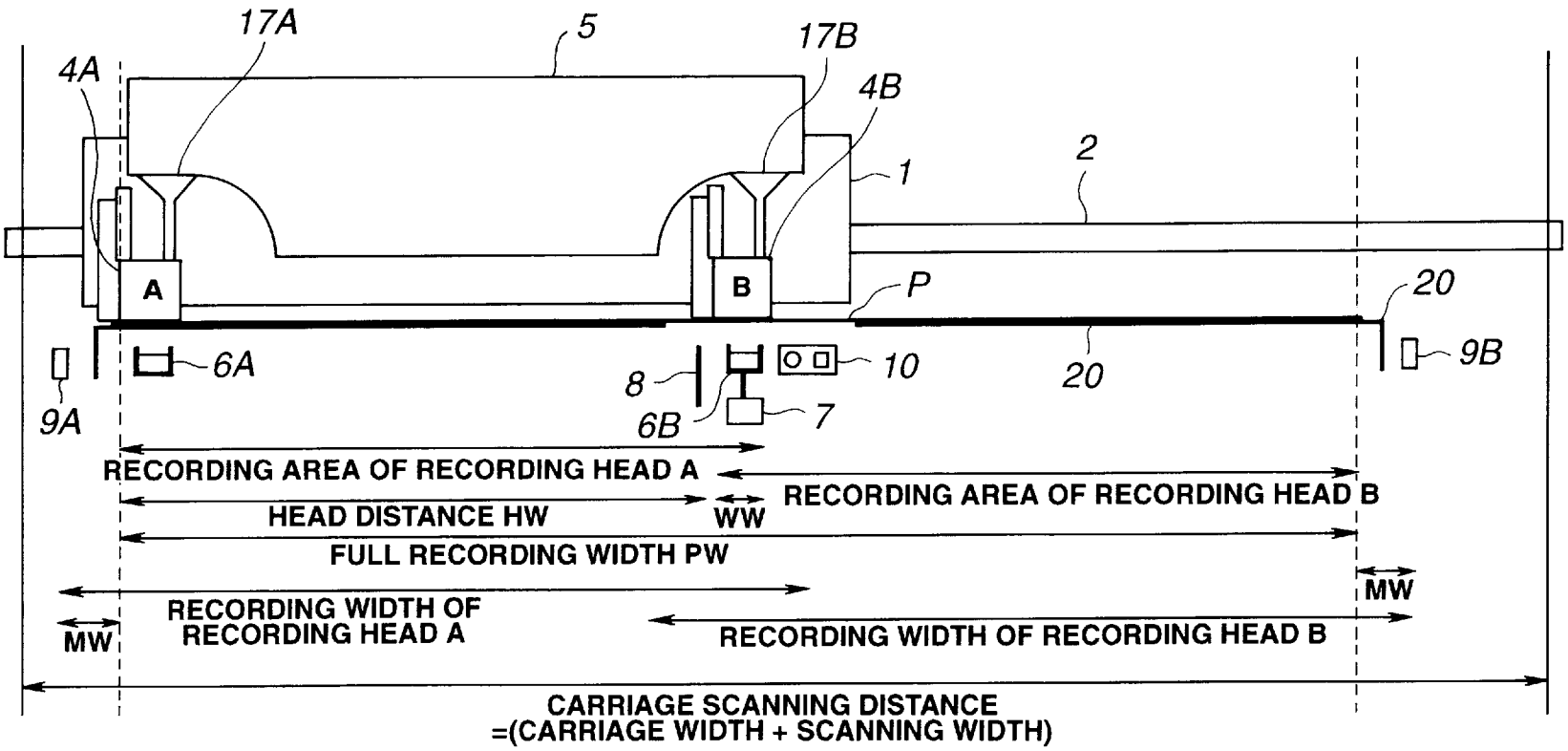
FIG. 2 is a front elevational view of the apparatus of FIG. 1.

The top plan and front elevational views of FIGS. 1 and 2 show a recording portion of an ink jet recording apparatus according to the present invention.

As shown in FIGS. 1 and 2, a recording medium P, such as a sheet of paper, is inserted into a feeding position in the recording apparatus and is conveyed horizontally by a feeding roller (not shown) in a direction shown by the arrow A to a recording area adjacent the recording apparatus. A platen 20 is provided under the recording apparatus to support the recording medium as it moves in the direction of the arrow A under the recording apparatus.

The recording apparatus includes a carriage 1 which is mounted to move bidirectionally along guide supports 2. The guide support 2 extends in the direction of an arrow B which is perpendicular to the direction of feeding movement of the recording medium P; and the carriage 1 scans back and forth over a recording area across which the recording medium P passes. Ink discharge recording heads 4A and 4B, which discharge ink, are provided near the ends of the carriage 1. An ink tank 5 is mounted in the central part of the carriage 1 and supplies ink to both recording heads 4A and 4B. The recording heads 4A and 4B discharge ink, according to received recording data, onto the recording medium P during a recording scan. Recovery system units in the form of caps 6A and 6B are provided under the left side and the center of the recording area. The caps 6A and 6B can move toward and cap the discharge portion of the recording heads 4A and 4B during non-recording periods. Ink supply conduits 17A and 17B extend from the tank 5 to the recording heads 4A and 4B, respectively, to supply ink from the tank to the heads.

In case of monochromatic recording, such as black and white, ink is supplied from one ink tank 5Bk which is relatively large. When color recording is performed and several different color inks are used, then additional ink tanks 5C, 5M and 5Y are also used, as shown in FIG. 1. In this embodiment the ink tanks 5Bk, 5C, 5M and 5Y are supplied respectively with black (Bk), cyan (C), magenta (M) and yellow (Y) inks. The capacity of each tank corresponds to the effect that each color is to produce. It is to be understood that these individual ink tanks can be exchanged independently of each other. each whose ink tank can exchange independently. Near each end of the carriage 1 there are provided four color integrated recording heads (4ABk, 4AC, 4AM and 4AY) and (4BBk, 4BC, 4BM and 4BY), respectively, which are connected via corresponding conduits 17 to the associated tanks 5B*k*, 5C, 5M and 5Y.

The resolution of the four color integrated recording heads 4 is chosen to be 360 dpi (dots per inch). In this case, the recording heads 4ABk and 4BBk are each provided with 64 ink discharge nozzles; and the other recording heads are each provided with 24 nozzles. The nozzles in each recording head are arranged in a line which is perpendicular to the direction of scan movement of the carriage 1 along the support 2. Spaces corresponding to eight nozzles are provided between each color group of ink nozzles.

As shown in FIG. 2, the two caps 6A and 6B are located, respectively, so that they register with the recording heads 4A and 4B when the carriage 1 is in its left hand position. Each of the caps 6A and 6B is arranged so that it can move toward and away from its respective recording head. Consequently, when there is no recording medium P in the recording area, the caps 6A and 6B can move to cover their respective recording heads 4A and 4B. This serves to prevent ink within the recording head nozzles from drying and increasing in viscosity and adhering to the nozzles during periods of non-recording.

The cap 6B communicates with a pump unit 7. If a degradation occurs in the discharge from either of the recording heads 4A or 4B, the pump unit 7 may be used to provide negative pressure withdraw ink from the discharge openings of the recording heads 4A and 4B while the cps 6A and 6B cover the heads.

Other forced ink discharge and recovery means of both the suction and the pressure type, for example, those which use a cylinder pump or a tube pump, are also advantageous.

In the embodiment shown in FIGS. 1 and 2, in cases where the forced recovery of ink by application of positive or negative pressure is not needed, and it is only necessary to prevent evaporation of ink from the nozzles, it is possible to prevent pressure variations within the cap due to temperature changes. This may be achieved by providing a semiatmospheric opening in the form of a thin hole in the caps 6A and 6B or a pump unit on both the caps 6A and 6B.

In the embodiment shown in FIGS. 1 and 2, the pump unit 7 is connected with only the right side cap 6B for the sake of simplicity. In this case the same pump unit 7 can provide a suction recovery on the left end recording head 4A by moving the carriage 1 so that the left end recording head comes into registry with the right end cap 6B and the pump unit 7. Waste fluid recovered by operation of the pump unit 7 is sent to a waste fluid tank which is not illustrated.

The left cap 6A may also be formed with a semiatmospheric opening such as a thin hole which communicates to the atmosphere as described above in connection with the cap 6B.

Another recording head maintenance apparatus is provided in the embodiment of FIGS. 1 and 2 in the form of a blade 8 which is positioned and arranged to wipe a discharge opening portion of the recording heads 4A and 4B. In order to wipe ink and process liquid which has adhered to the face of the discharge opening of the recording heads 4A and 4B, the blade 8 is formed from an elastic material such as gum.

The one wiper blade 8 is used in common for both of the recording heads 4A and 4B; and it is arranged to be moved up and down by a not shown fluctuating apparatus. When the blade 8 is moved to its upper position, it wipes the recording head surface; and when it is moved to its lower position it avoids interference with the recording head surface. While two blades may be provided corresponding to the two recording heads 4A and 4B, in the embodiment of FIGS. 1 and 2, only one blade is provided in a central area and this one blade operates in common on the two recording heads 4A and 4B, thereby simplifying the structure.

The caps 6A and 6B, the pump unit 7 and the wiper blade 8 are referred to herein collectively as "maintenance" or "servicing" units because they act on, and service, the recording heads 4A and 4B to ensure the smooth, continuous and instantaneous flow of ink from, or the effective transfer of color agent by, the recording heads. It will be noted that the cap 6B, the pump unit 7 and the wiper blade 8 are located in the area which is overlapped by the two recording heads 4A and 4B during scanning. This permits the same cap 6B, pump unit 7 and wiper blade to act on both recording heads from a single location, thereby achieving simplicity and economy of construction and more reliable operation.

A further servicing or maintenance apparatus for the recording heads 4A and 4B is provided in the form of preliminary discharge receivers 9A and 9B which are located on both sides of the recording medium P beyond the area of recordation. These preliminary discharge receivers operate to prevent changes in the discharge characteristic of the recording heads 4A and 4B and of color mixing which are caused by ink having been evaporated to some extent from an unused nozzle during recording or while the heads are on recording stand-by. The receivers 9A and 9B are used when ink is made to discharge from the nozzles during intervals other than the actual recordation intervals. Since a preliminary ink discharge may be necessary prior to the actual recording period, it is necessary to provide the receivers 9A and 9B in areas outside the area occupied by the recording medium P.

There is also provided in the embodiment of FIGS. 1 and 2 a servicing or maintenance apparatus in the form of an ink sensor 10 near the recording heads 4A and 4B to detect the presence or the absence of ink in the ink tank 5. This ink sensor also serves as a maintenance apparatus which provides an indication or a warning to the user that an ink tank should be replaced. In this embodiment, the ink sensor 10 is in the form of an optical sensor which is located under the central part of the platen 20. This ink sensor checks the ink tank 5 at the start and at the end of recording when the recording medium P is not present in the recording area. The sensor 10 thus serves a double purpose in that it senses not only the presence or absence of ink in the tank 5; but it also senses the presence or absence of the recording medium P in the recording area. It will be noted that the ink sensor 10 is also located in the area which is overlapped by the two recording heads 4A and 4B during scanning.

Each of the items 6, 7, 8, 9, and 10 constitutes a servicing or maintenance apparatus which operates to help maintain optimum operation of the recording heads so that they continue to effectively transfer color agent to the recording medium. Thus, as used herein, the term "servicing apparatus" or "maintenance apparatus" is intended to mean any apparatus which operates to help maintain optimum operation of the recording heads.

The ink jet recording apparatus of the embodiment of FIGS. 1 and 2 uses a recording system in which heaters in the form of electro-heat converters are provided at each ink discharge opening. A drive signal corresponding to recording information is applied to the heater and generates heat in the respective nozzle to cause a droplet of ink to discharge from the nozzle.

Figure 3:
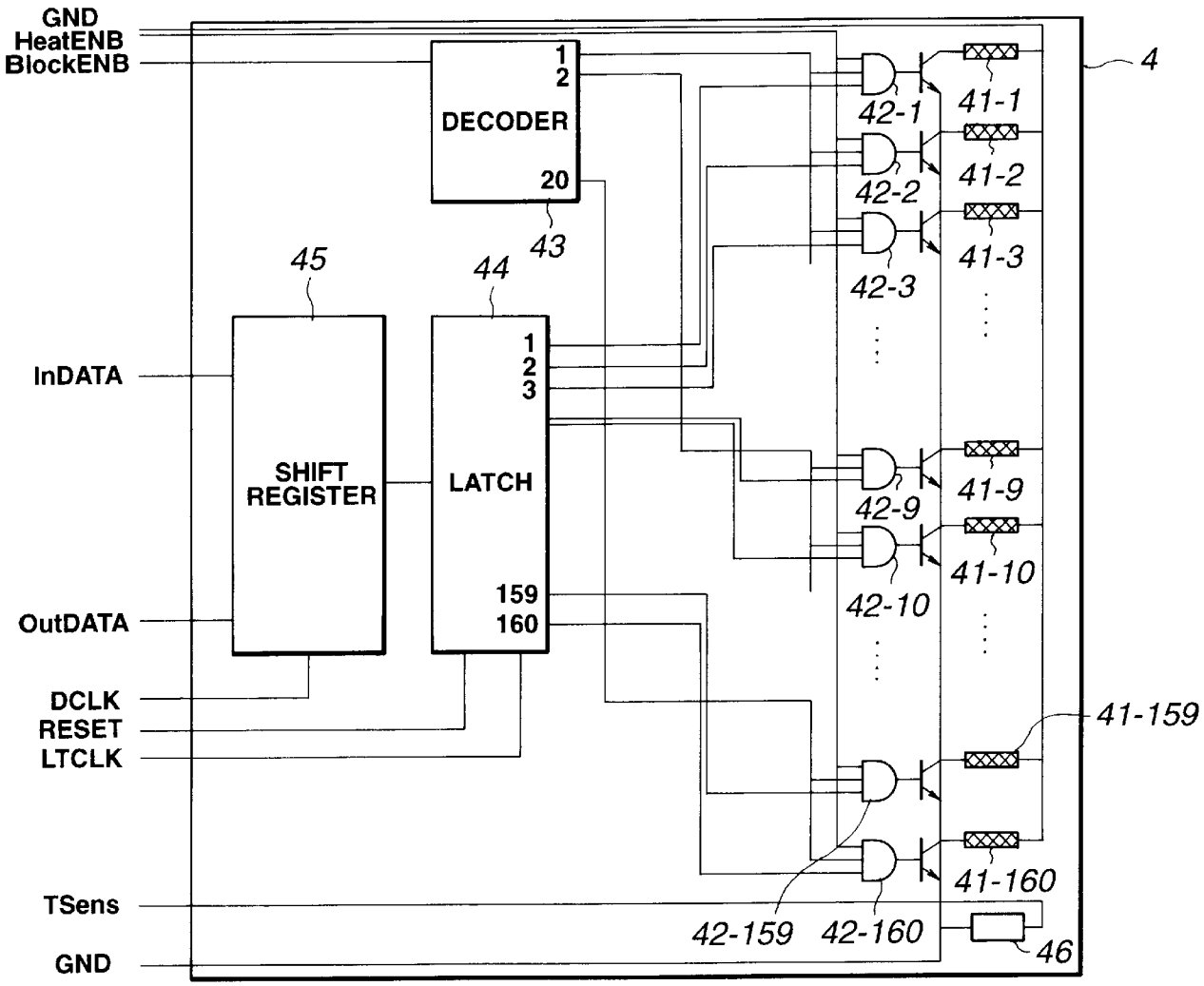
FIG. 3 is a block diagram showing a heating element control arrangement in a printing head portion of the apparatus of FIGS. 1 and 2.

The block diagram of FIG. 3 shows the arrangement for driving the recording head heaters of the recording apparatus of FIGS. 1 and 2. Heaters 41-1 . . . 41-160 are arranged in the respectively associated nozzles of the recording heads 4A and 4B. These heaters are structured to respond to received data signals to heat the ink within their respective nozzles.

In cases where all of the heaters 41 are to be driven at the same time, the flow of electrical current is quite high, which causes a corresponding increase in the power supply load. Under these conditions the power which can be supplied to the individual heaters decreases by an amount corresponding to the voltage drop resulting from the increased flow of current through the wiring which supplies current of the heaters. This decrease in power reduces the heating effect within the nozzles which results in a deterioration of recording quality. In order to overcome this problem, the recording heads 4 are somewhat slanted and they are operated according to a known time sharing sequence wherein the timing of recording is adjusted to the image data for each of the plural nozzle groups.

Various time division driving methods can be used for this purpose. In this embodiment, each recording head 4A and 4B is divided into 20 blocks of 8 nozzles, together with a space, corresponding to the distance occupied by 8 nozzles, between each nozzle group corresponding to a particular color. Each group of nozzles is operated in sequence and for a predetermined time interval. Corresponding to this, the multi nozzle recording heads 4A and 4B are inclined at only the angle which is commensurate with the scanning speed of the recording heads.

Ink within each nozzle is rapidly heated by the nozzle heater 41 and experiences film boiling to form a bubble by film boiling. The pressure which is generated by this bubble formation causes a droplet of ink to be discharged from the nozzle and projected onto the recording medium P. In this manner a character is formed on the recording medium. The composite of these characters forms an overall image. The volume of each ink droplet is about 40 ng (nanograms, namely $10^{-9}$ grams).

An ink liquid path is provided between a common liquid chamber in each recording head and each of several discharge openings on the head. These discharge openings face the recording medium P. A separate liquid chamber is provided for each color ink; and a separate ink path extends from each chamber to a corresponding discharge opening on each of the two heads.

Ink is supplied from the tanks 5, according to color, through ink supply paths to the common liquid chambers on the two heads.

In an ink liquid path corresponding to each of a discharge opening, heaters 41 and associated electrode wirings to supply electric power to the heaters 41 are provided. Heaters 41 are electro-heat converters that generate heat energy utilized to discharge ink drops from the discharge openings.

The heaters 41, and the electrode wiring which supplies current to the heaters, are formed by film forming technique on a non-conductive board such as silicone. A protective film is formed on the heaters 41 so that heaters 41 do not directly touch the ink. The nozzles, which extend from the common liquid chamber to the nozzle discharge openings are formed by laminating a grooved partition, which comprises resin and a glass agent, onto the non-conductive board.

This recording system uses heaters 41 which, by means of electro-heat, produce a bubble in the ink which passes over them each time such heater receives a signal. The expansion of this bubble forces a drop of liquid ink to discharge from the discharge nozzle and project toward the recording medium. This process is referred to herein as a "bubble jet" recording system.

As shown in FIG. 3, AND gates 42-1 . . . 42-160 are connected to supply current to drive the respective heaters 41 based on the concurrence of selected signals from a decoder 43, which controls time sharing, and a latch circuit 44 which supplies image data, as well as a heat enable signal which drives the heaters 41 and defines drive time. A shift register 45 converts image data, which is supplied serially, into parallel form and supplies this data to the latch circuit 44.

A temperature sensor 46 is provided on the recording heads 4A and 4B to monitor their temperature. By using the sensor 46, the optimum drive condition of the recording heads is determined. Also the above describe maintenance apparatuss can be controlled from this sensor. In this way it is possible to maintain stabilized recording.

Figure 5:
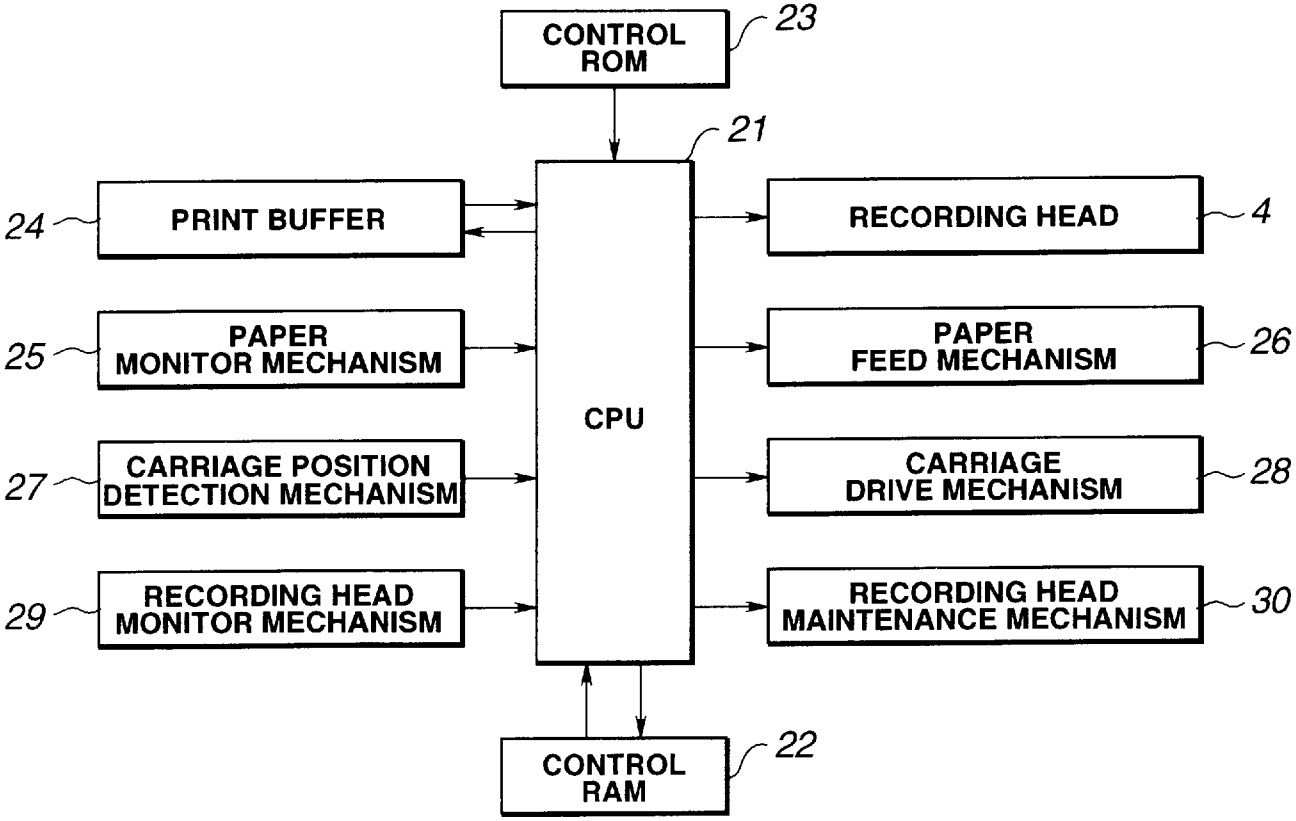
FIG. 5 is a block diagram of a recording apparatus in which the present invention may be incorporated.

The manner in which the above described recording apparatus is controlled is illustrated in the block diagram of FIG. 5. Image data from a host computer is first supplied to a reception buffer (not shown) which, after confirmation that the data has been properly transferred and that the operating condition of the recording apparatus is correct, supplies the data to the recording heads 4A and 4B (FIGS. 1 and 2). The recording heads 4A and 4B are controlled by a Central Processing Unit (CPU) 21, a Random Access Memory (RAM) 22 and a Read Only Memory (ROM) 23 after the data from the reception buffer has been temporarily stored in a print buffer Random Access Memory (RAM) 24. The CPU 21 controls a paper feeding mechanism 26 which drives a paper feed roller and a line feed roller (not shown) based on information received from a paper monitoring mechanism 25. The CPU also controls a drive mechanism 28 for the carriage 1 (FIGS. 1 and 2) based on information from a carriage position detection mechanism 27. In addition, the CPU 21 controls a recording head maintenance apparatus 30 which in turn performs maintenance and optimization operations on the recording heads 4A and 4B based on information from a recording head monitoring mechanism 29 which detects the temperature of the recording heads, the presence or absence of ink in the tanks 5, etc.

Reverting now to FIGS. 1 and 2, it will be seen that the carriage 1 is mounted to move bidirectionally along the guide supports 2. The rail 3, which extends along the carriage 3 parallel to the direction of the supports 2, receives driving forces from a drive connector 12 to cause the carriage to scan back and forth in the direction of the arrow B. During such scanning, the recording heads 4A and 4B discharge ink from both ends of the carriage 1; such ink being supplied from the common ink tank which is located in the central part of the carriage 1.

The rail 3 in the embodiment of FIGS. 1 and 2 is in the form of a rack gear which extends along the carriage 1. This rack gear may be integrally formed by molding it onto the surface of the carriage 1; or it may be a separate gear rack which is attached to the carriage. The rail 3 may be directly or indirectly coupled to a carriage motor 11 which serves as a carriage drive source. In the embodiment of FIGS. 1 and 2, the rail 3 is coupled with a drive connector in the form of a carriage gear 12 which is provided in the central region of the scanning area. This allows the carriage drive motor 11 to rotate the carriage gear 12 so as to drive the carriage bidirectionally so that it scans over the entire scanning area. As can be seen, the carriage gear 12, which transfers driving forces from the carriage drive motor 11 to the carriage 1 via the rail 3, is located in the region which is overlapped by the carriage 1 during scanning. Thus the carriage 1 can be driven to scan over a large recording area without requiring any significant increase in the overall width of the recording apparatus. It is preferable that the carriage gear 12 be located at a distance from the outer edge of the area scanned by the recording head 4B by an amount at least as great as the width of that area. This permits the gear 12 to drive the carriage 1 over the full recording area without requiring the carriage to extend beyond the outer edges of the recording apparatus.

The use of a direct drive from the drive motor 11 to the carriage 1 makes it possible to simplify the structure and avoid the complexity found in previous structures which used a wire and a timing belt. In addition, the use of the direct drive makes it possible to maintain high quality printing by avoiding the expansion and contraction problems which occur in a wire and a timing belt with variations of carriage scan speed. In this the use of a rack gear provides further improvement. It will be appreciated that a friction drive roller can be substituted for rack gear shaped rail member 3 and the carriage gear 12.

In this embodiment, in order to drive the carriage with high accuracy, a linear encoder is used as a carriage position detection mechanism. Other position detection mechanisms can also be used which employ principles of optics, magnetism, etc. Further, a linear encoder may be provided at one end of the carriage 1. In this embodiment, there is provided an encoder sensor 14 with an optical system using reflected light to sense the carriage position. The encoder sensor 14, which is mounted in a fixed position on the apparatus in which the carriage scans, detects the movement of a linear detection device (marker) 13 which extends along the side of the carriage in the scanning direction.

In ink jet recording, where the recording element does not contact the recording medium, it is important to maintain the position of the carriage 1 with high accuracy. This high accuracy is achieved in this embodiment by maintaining the recording heads 4A and 4B fixed to both ends of the carriage 1 and by the provision of a rail such as the rack 3 directly on the carriage. Also, it is possible to achieve high accuracy movement of the carriage 1 by the integral formation of the linear detection device (marker) 13 on the carriage 1.

It is also possible to provide high scanning speed by use of a linear drive motor. In this case, a row of magnetic poles can be provided on the carriage in a straight line along the direction of scan.

In order to provide sequential recordation in a predetermined interval with each nozzle group, a time divisional driving method is used together with the inclination of the recording heads 4A and 4B at an angle which is commensurate with their scanning speed. It is necessary that the recording interval for each nozzle group coincides with the scanning speed of the recording heads 4A and 4B, otherwise a gap occurs in the recording position of the heads and the quality of recordation is reduced. Therefore, it is especially important to stabilize the scan speed of the carriage. According to this embodiment, as mentioned above, the recording quality is improved by stabilization of the carriage scan speed.

Figure 6:
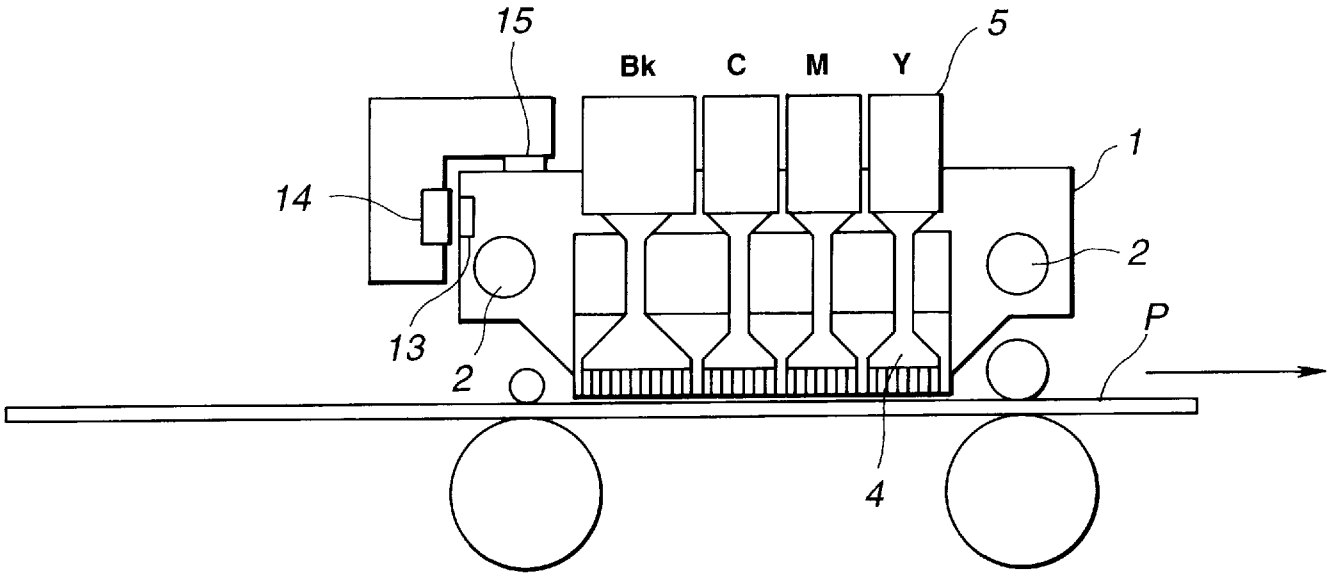
FIG. 6 is a diagrammatic view taken along line 6-6 of FIG. 2, but showing an alternate carriage drive arrangement.

Further as shown in FIG. 6, when a quiet and high accurate drive is required, it is also possible to structure a drive source by a supersonic wave motor 15. The motor 15 impresses a supersonic drive wave against a linear rail 13*a* which extends along the carriage 1 as in the preceding embodiment. The carriage 1 is directly driven by the force imposed from the supersonic wave motor 15 onto the rail 13*a*. The rail 13*a* may take the form of a mirror surface with an accuracy which is commensurate with that of the supersonic waves from the motor 15. In the embodiment of FIG. 6 also, the driving force from the motor 15 is imposed on the rail 13*a* at a location which is overlapped by the two recording heads 4A and 4B during their scan. As described above in regard to the location of the drive gear 12 of the preceding embodiment, this serves to simplify the overall construction of the apparatus and to avoid the need to widen the device.

In FIG. 6, the carriage 1 supported on the two guide supports 2 so as to move in the scanning direction. A supersonic wave element (not shown) is fixed to the rail 13*a* which may be integrally formed by molding on the carriage 1 with high accuracy, so that the carriage 1 is directly driven. In addition, a marker 15 which extends along the carriage in the direction of scan, is provided for the position detection by a linear encoder sensor (optical sensor) 14 to control the carriage position. In FIG. 6, the return loop of the supersonic wave drive element is not illustrated, as such devices are conventional.

In the embodiment of FIG. 6, the supersonic wave drive motor 15 and the optical sensor 14 are fixed on a common support body. Because of this, it is possible to achieve high precision in the positioning of the rail 13*a* and the marker 14 which are solidly fixed on the carriage 1. A supersonic wave direct drive system is suitable especially in this embodiment in which both the carriage and the drive source are directly connected. In this case there is no need for any special speed reduction mechanism; and no need for control of cogging and variations in torque due to variations in ink in the tank 5. Thus, it is possible to keep the structure simple and accurate. It will be appreciated that the embodiment of FIG. 6, which uses a supersonic wave drive system provides significant advantages compared to a carriage scan drive system which uses a wire and a timing belt.

It is possible to improve the control of drive force even more by providing supersonic wave drive elements which act on both the top and bottom of a drive rail on the carriage 1.

The arrangement and operation of the elements associated with the carriage 1, which include a carriage drive mechanism 28, the recording heads 4A and 4B, the recording head servicing or maintenance apparatuss 30, etc., will now be explained in detail.

FIG. 2 shows the carriage 1 at its position at the left end of a recording scan. The recording heads 4A and 4B on the carriage 1 are separated from each other in the direction of scan by a head interval HW of 100 millimeters (mm) so that the recording head 4A at the left end of the carriage is positioned at the left edge of the recording area, the width PW of which is 206 mm. At the same time the recording head 4B at the right end of the carriage 1 is positioned at the right edge of an overlapped recording area whose width WW is 6 mm. This overlapped area is provided to ensure print continuity, as will be explained hereinafter. The relationship between the head spacing HW, the width of the print area PW and the width of the overlaped area WW is: d the overlapped area WW is:

$$HW=(PW-WW)/2.$$

Figure 4:
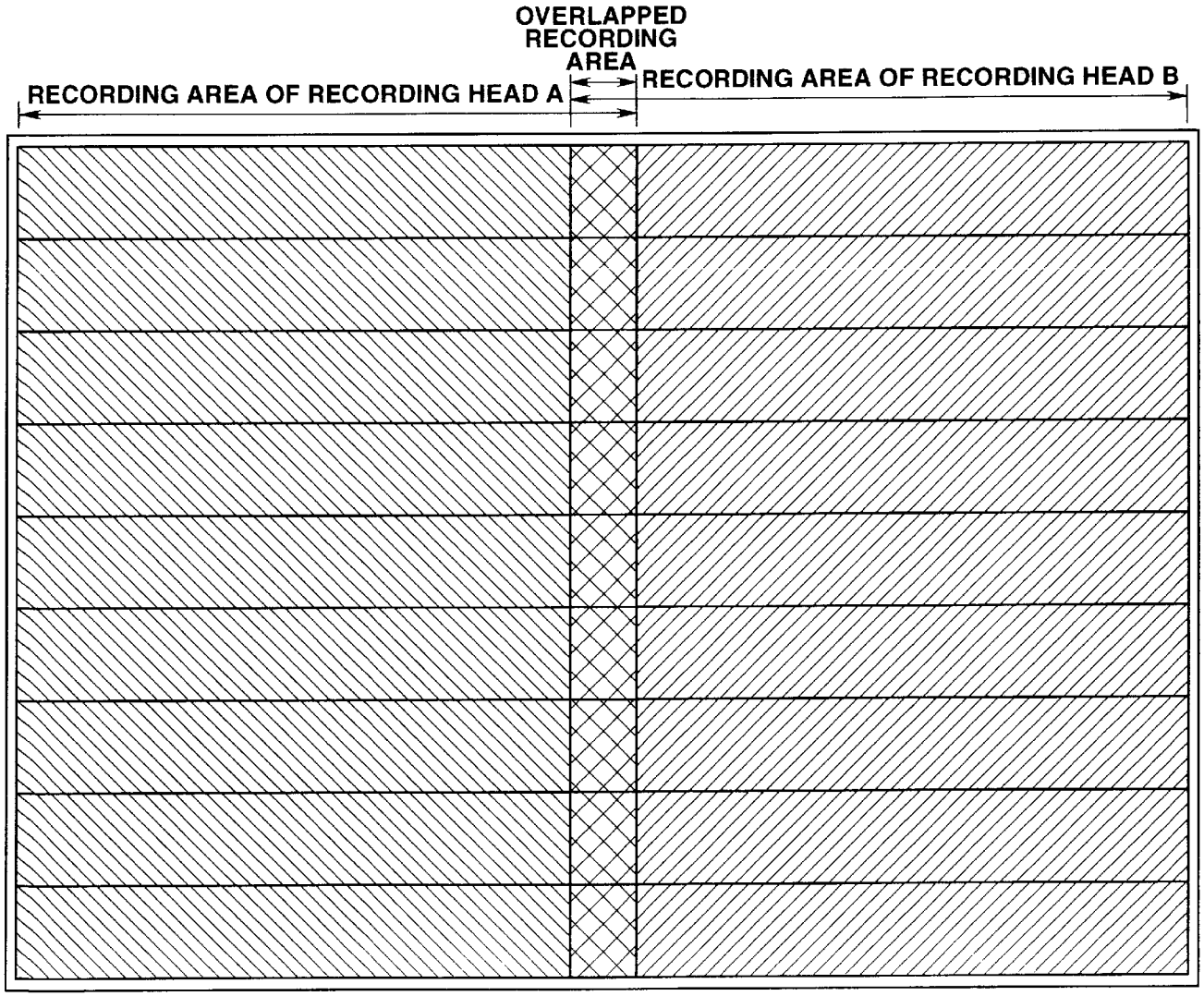
FIG. 4 is an explanatory diagram showing recording areas covered by different recording heads in the apparatus of FIGS. 1 and 2.
Figure 7:
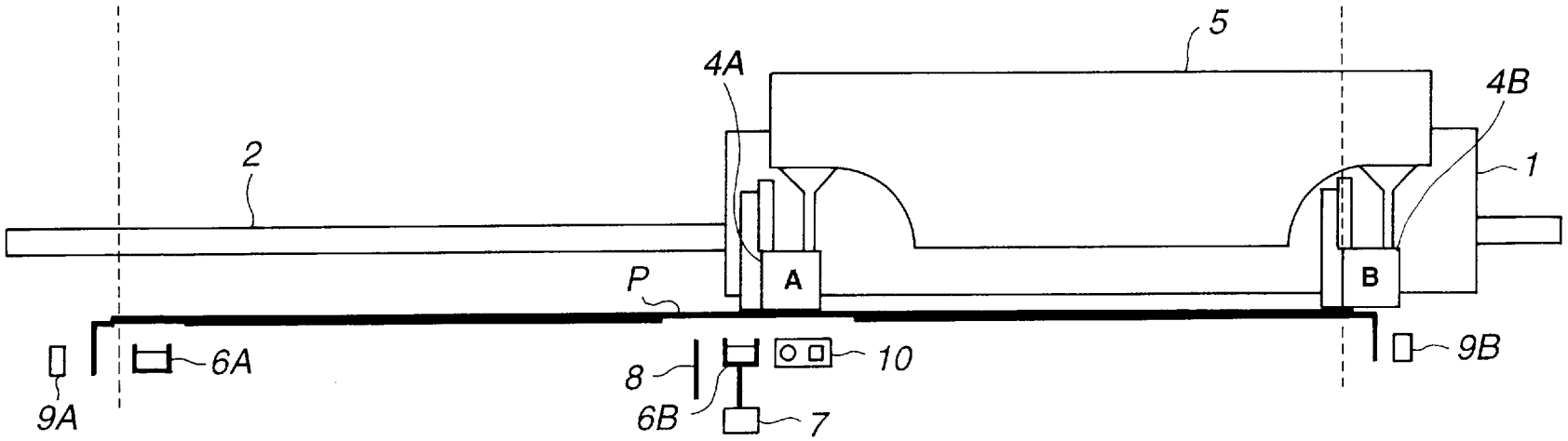
FIG. 7 is a view similar to that of FIG. 2 but showing a printing carriage at the right most extent of is travel.
Figure 8:
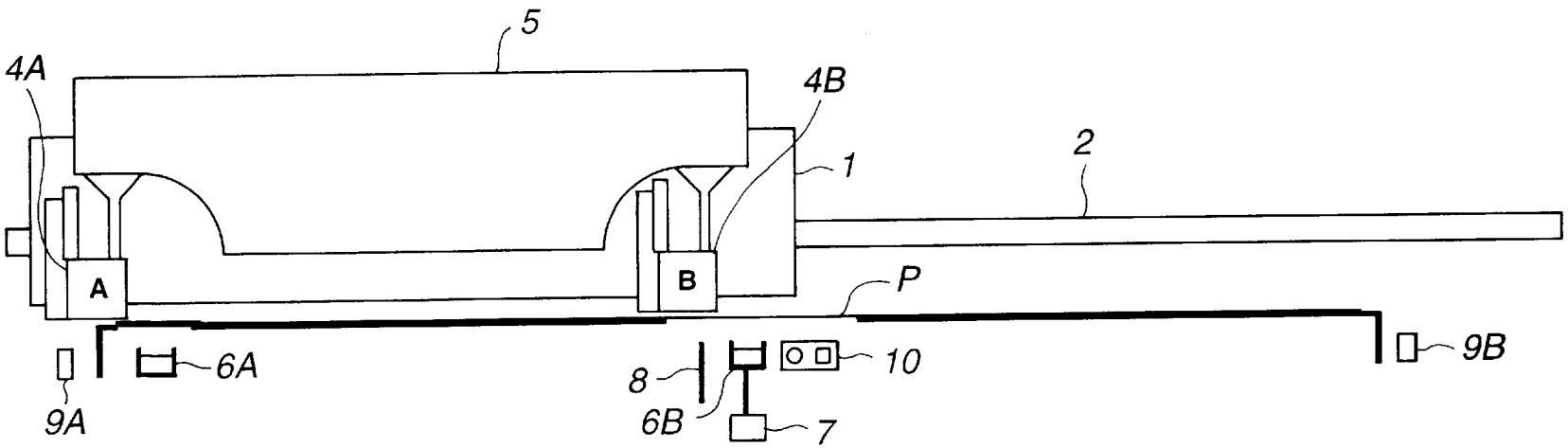
FIGS. 8 and 9 are views similar to that of FIG. 2 but showing the printing carriage at the extreme left and right positions of its travel, respectively.
Figure 9:
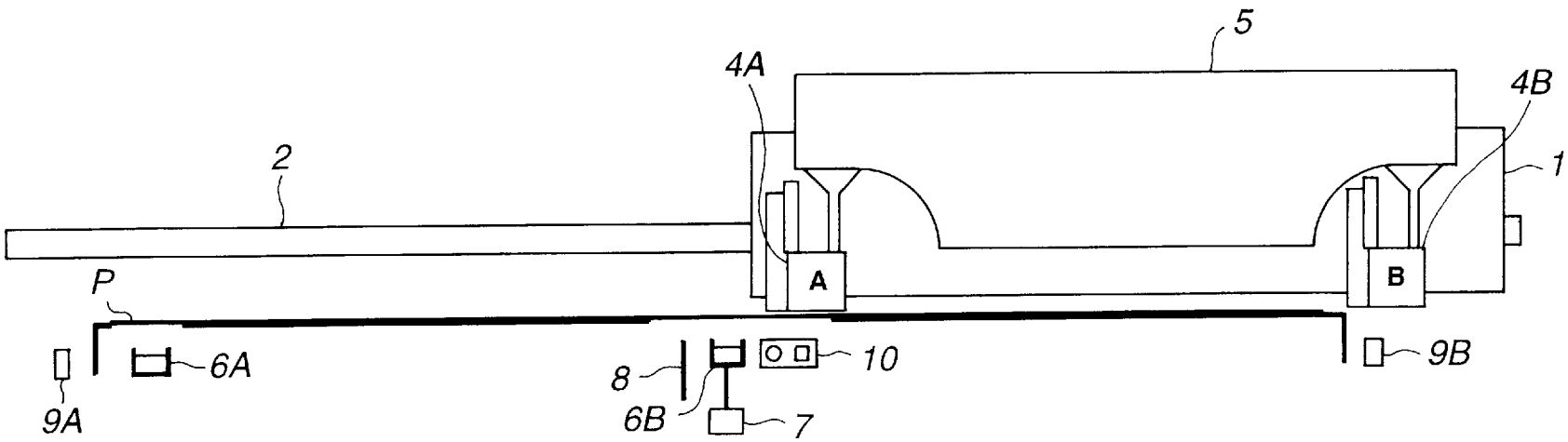

FIG. 7 shows the position of the carriage 1 at the right end of a recording scan. As can be seen, the recording head 4B at the right end of the carriage 1 is positioned at the right edge of the recording area (the width PW of which is 206 mm). At the same time, the recording head 4A at the left end of the carriage 1 is positioned at the left edge of the overlapped recording area (the width WW of which is 6 mm). As the carriage 1 scans from this position, it is moved in a leftward direction by a distance of 106 mm to the left position as shown in FIG. 2. Therefore, the recording head 4A records an area of 106 mm on the left side of the full recording width PW while the recording head 4B records an area of 106 mm on the right side of the full recording width PW; and the overlapped recording area WW which occupies a width of 6 mm in the central region of the full recording area PW, is recorded in a shared manner by the two recording heads 4A and 4B, as seen in FIG. 4.

As mentioned above, the preliminary discharge receivers 9A and 9B provided along both sides of the full recording area PW, serve as one of several recording head servicing or maintenance apparatus. In recording, it is sometimes necessary to drive the carriage 1 so that the recording heads 4A and 4B reach the position of the preliminary discharge receivers 9A and 9B. In order to reach these positions, the carriage 1 is driven leftwardly so that the discharge nozzles of the left recording head 4A reach a position which is located beyond the left edge of the full recording width PW by a distance of 10 mm (referred to herein as a Preliminary Discharge Width MW); and the carriage 1 is driven rightwardly so that the nozzles of the right recording head 4B reach a position which is located beyond the right edge of the full recording width PW, also by a distance of 10 mm.

During the scanning movement of the carriage 1, it is also usually necessary to provide an extra scan distance (referred to herein as the Acceleration and Deceleration Width) so that the carriage 1 can be brought up to scanning speed and thereafter stopped at the end of each scan. A preliminary ink discharge can be carried out during the period that the carriage is moving through the Acceleration and Deceleration Width. In the embodiment shown, the actual carriage scanning distance SW meets relation of:

$$SW=\{(PW+WW)/2\}+2MW$$

The Acceleration and Deceleration Width is shorter than the Preliminary Discharge Width PW and therefor is already accommodated in the above formula.

Where, as in this embodiment, a direct drive is used to cause the carriage 1 to scan, the rail 3 should extend into the center of the carriage scanning area and should have a Rail Length RL not less than an Added Length (AL) of about 2 mm beyond the right and left ends of the carriage scanning distance SW. Also, since the rail 3 is integrally formed on and is supported by the carriage 1, the carriage length (CW) in the carriage scanning direction should be not less than the rail length RL. Moreover, though length of linear detection device 13 of the linear encoder provided on the scanning carriage 1 should be not less than the carriage scanning distance in order to provide detection of carriage position, if the detection occurs in the center region of the scanning area, the Carriage Length CW in the scanning direction should be not less than 130 mm which is the same as the rail length RL. In other words, the minimum length of the carriage 1 in the direction of scan should correspond to the relationship:

$$CW=\{(PW+WW)/2\}+2MW+2AL.$$

Figure 14:
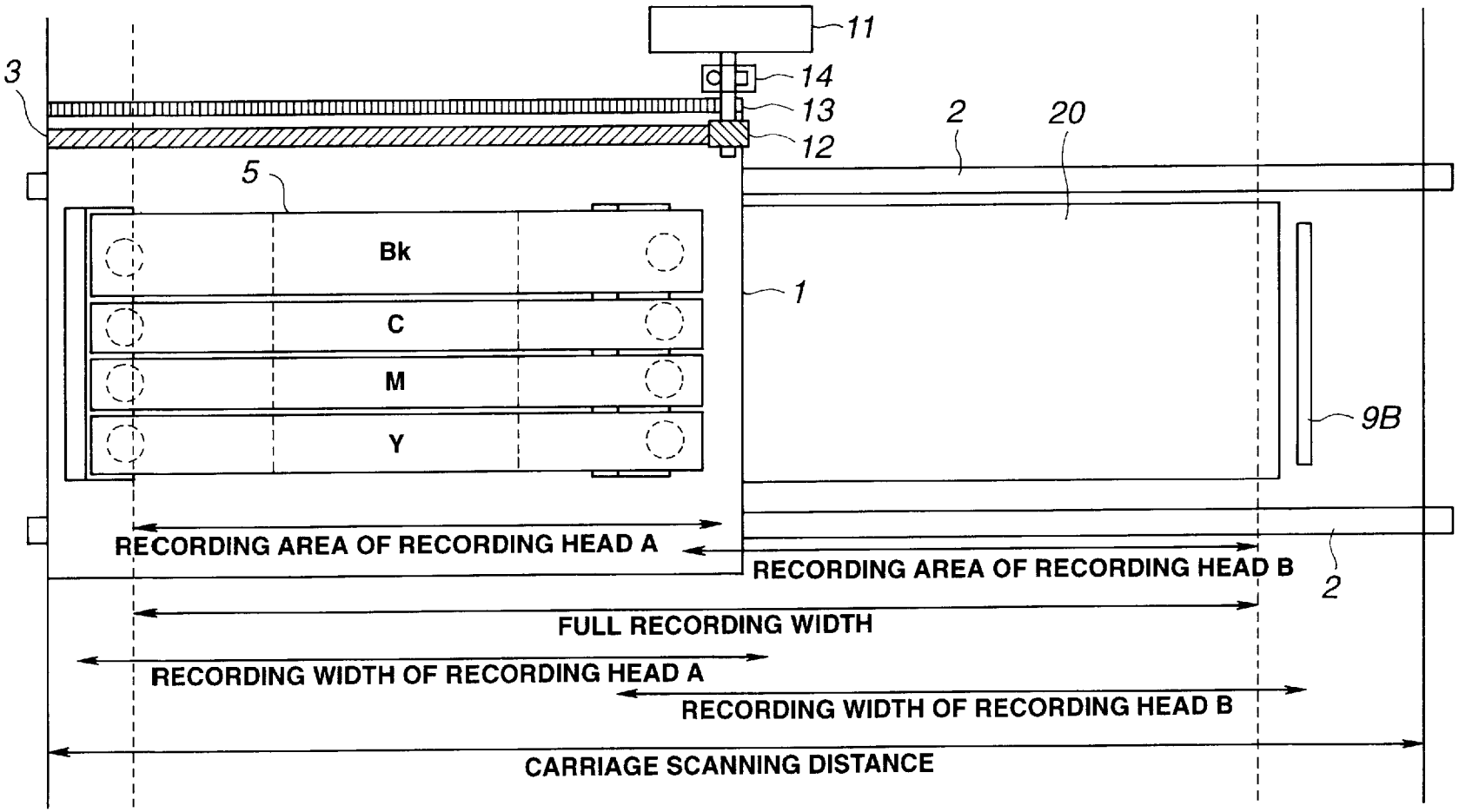
FIGS. 14 and 15 are views similar to that of FIG. 1 but showing the carriage at its extreme left and extreme right hand positions, respectively.
Figure 15:
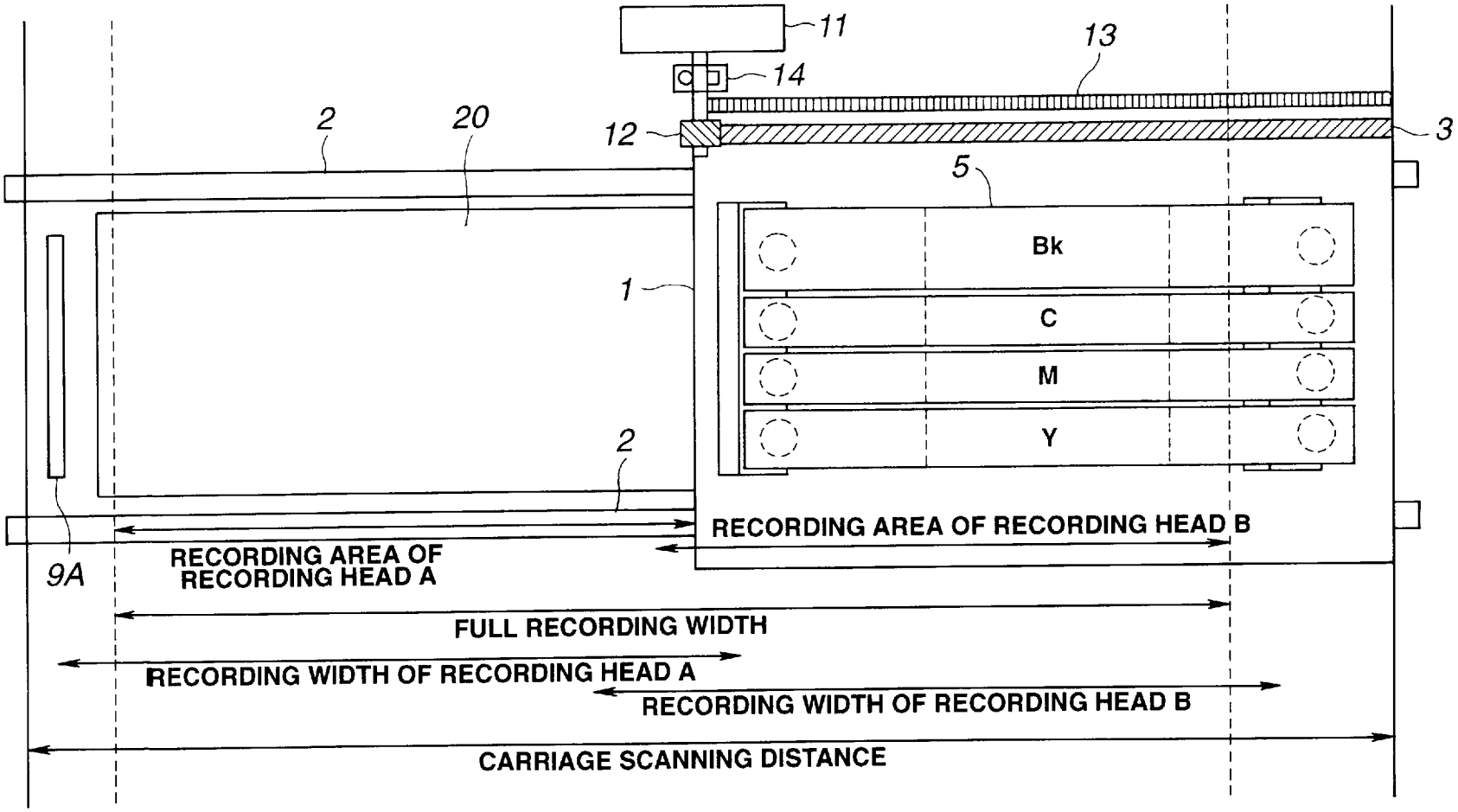

The total scanning distance CSAW occupied by the carriage 1 during scanning comprises the length of the carriage in the direction of scan plus an extra carriage scanning distance which, as shown by FIGS. 14 and 15, is a minimum of 256 mm. The 50 mm excess over the 206 mm full recording width PW is required to accommodate the Overlapped Recording Width WW, the Preliminary Discharge Width MW and the extra distance needed for driving the carriage. Specifically, the relationship:

$$CSAW=PW+WW+4MW+2AL$$

should be followed.

The dual head embodiment of the present invention may be compared with a single head carriage which is driven by a wire drive, in the following manner. Since, in a single head carriage, the width of an ink tank must be added to the preliminary discharge width on one side, drive room must be added on both sides and acceleration and deceleration width must be added to one side, the difference between the two recording head embodiment of this invention and single head printers of the prior art corresponds closely with the difference between the sum of the overlapped recording width (WW) and the two preliminary discharge widths (MW) on the one hand and the width of an ink tank on the other hand. According to above-described numerical example, in the case where width of an ink tank is 20–30 mm, both width both becomes roughly equal scanning space of the carriage In this embodiment, it is possible to use the entire width of the carriage 1 for the ink tank 5. Because of this it becomes possible to use an ink tank whose capacity is increased by four times. In addition, since the scanning distance of during recording period is short, about double recording speed can be realized. Thus, the present invention is especially advantageous when a color agent such as ink is loaded on the carriage 1 for recording.

Further, since two recording heads are used in the present embodiment, the frequency of use of each recording head is cut in half; and the life span of each recording head is doubled. And, when a simple direct drive is used to drive the carriage 1, this embodiment has performance that more than makes up for the cost of the additional recording head. Although the embodiment of FIGS. 1 and 2 provides for color recording, the advantageous effects described above can be expected in the case of monochromatic recording. In addition, since the problem of an ink tank capacity is especially significant in the case of color recording, due to the requirement of plural ink tanks, it is apparent that the present invention provides markedly advantageous effects.

As described above, in this invention the full width of the recording area of the recording medium P is divided into two recording areas in the direction of scan of the carriage 1. Additionally, plural recording heads 4A and 4B are provided on the carriage 1 at a predetermined interval to perform recordation in each of the plural divided recording areas, respectively. Also, the rail portion 3 is integrally arranged with the carriage 1 along the scanning direction; and the length of the rail corresponds to a scanning distance needed both to record and to provide maintenance for the recording heads 4A and 4B.

Finally, a connection portion, such as a gear 12 is provided within the range of scanning of the carriage 1, and preferably at or near the center of a scanning area of the carriage 1 to connect the drive source 11 which connects the rail portion 3 to scan the carriage 1.

As described above, high-speed image recording is obtained by the use of plural recording heads. Also, the use of plural recording heads make it possible to obtain highly accurate recording can be obtained with a simplified structure. Moreover, the deterioration of printing accuracy due to variations in carriage speed can be reduced by use of time divisional recording.

Additionally, since the ink tank 5 is located on the carriage 1 between the two recording heads 4A and 4B and supplies ink in common to both heads, the overall weight of the carriage is minimized.

Figure 10:
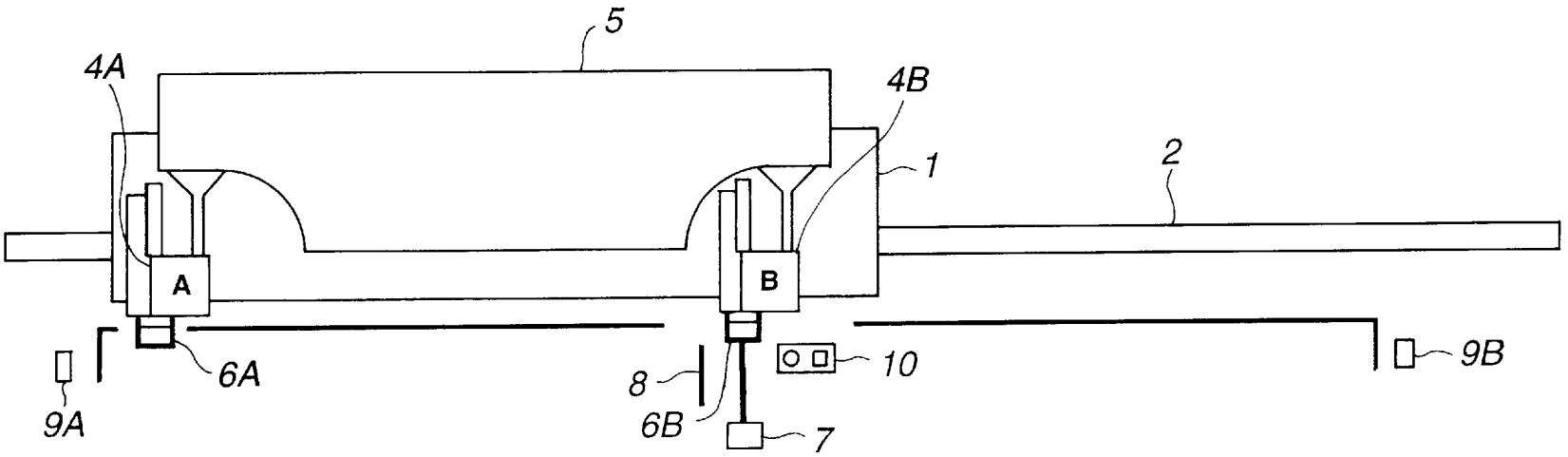
FIG. 10 is a view similar to that of FIG. 2 but showing the capping of the recording heads and the application of suction to the right hand head with the carriage in the left hand position.

The operation of the maintenance apparatuss for the recording heads 4A and 4B will now be explained in detail. A preliminary discharge of ink from the recording heads 4A and 4B can be performed during a non-recording period whenever necessary. This is because the preliminary discharge is performed while the carriage is at a position where the ink discharge nozzles are outside the recordation area of the recording medium P. The caps 6A and 6B, which comprise one of the maintenance apparatuss for the recording heads 4A and 4B, are provided at the same interval or spacing in the direction of scan as the interval between the recording heads 4A and 4B under the recording area of recording medium P as shown in FIG. 10. For this reason, after the carriage 1 is moved to a predetermined position at the time of the condition that there is no recording medium P in the recording area, the caps 6A and 6B are moved upwardly to cover the recording heads 4A and 4B. If both caps 6A and 6B are connected with a pump that forces a discharge of ink from the recording heads, it is possible the to maintain or recover ink from both recording heads. In the embodiment described herein, in order to simplify the maintenance apparatus a pump is connected with only one cap, namely, the central cap 6B; and the pump operates on only recording head 4B, as shown in FIG. 10.

Figure 11:
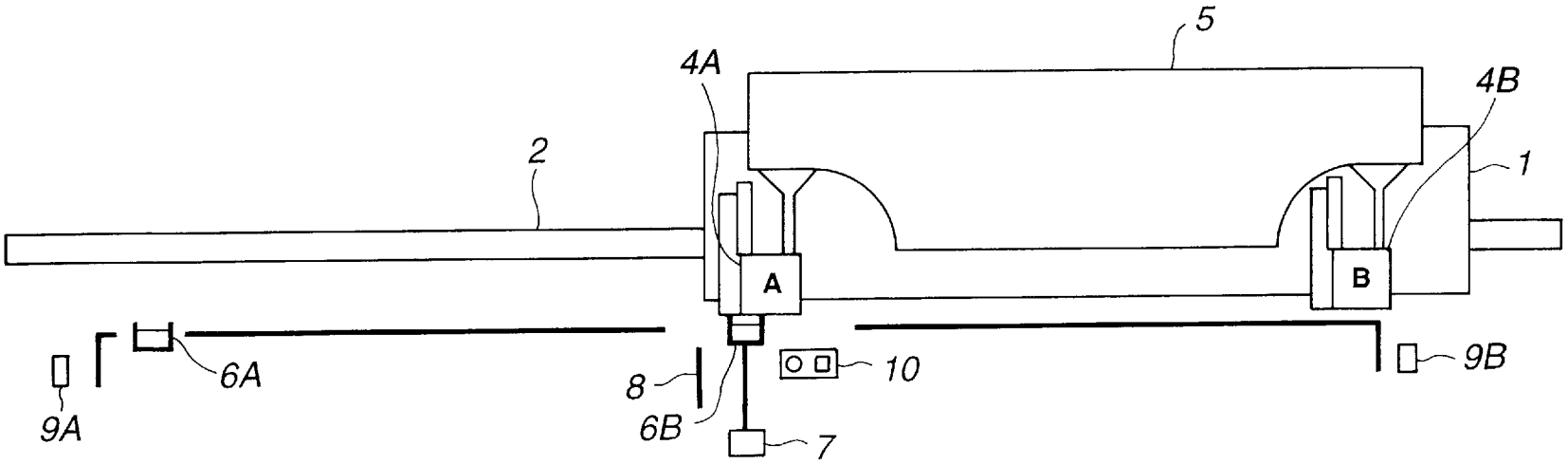
FIG. 11 is a view similar to that of FIG. 10 but showing the application of suction to the left hand head with the carriage in the right hand position.

After the carriage 1 is moved, as shown in FIG. 11, to face toward the central cap 6B, and the cap is moved to cover the recording head 4A, ink is forced from the recording head by operation of the pump 7. The left cap 6A may be provided in any position so long as it is within the scanning area of the recording head 4A. The central cap 6B can be provided within the scanning areas of both the recording heads 4A and 4B because these two heads share an overlapped scanning area.

From the viewpoint of its function, the cap 6B does not have to be provided within the overlapped recording area; however, it should be provided within an area over which both the recording heads 4A and 4B pass. Though the recording areas where the recording heads 4A and 4B record also are overlapped in this embodiment, in the case where an overlapped recording area is not provided, some other overlapped area, for example in the acceleration and deceleration area should be utilized. As can be seen in FIGS. 8 to 11, since central cap 6B is arranged in the overlapped area where two recording heads 4A and 4B scan, it can operate on both these heads in common.

Figure 12:
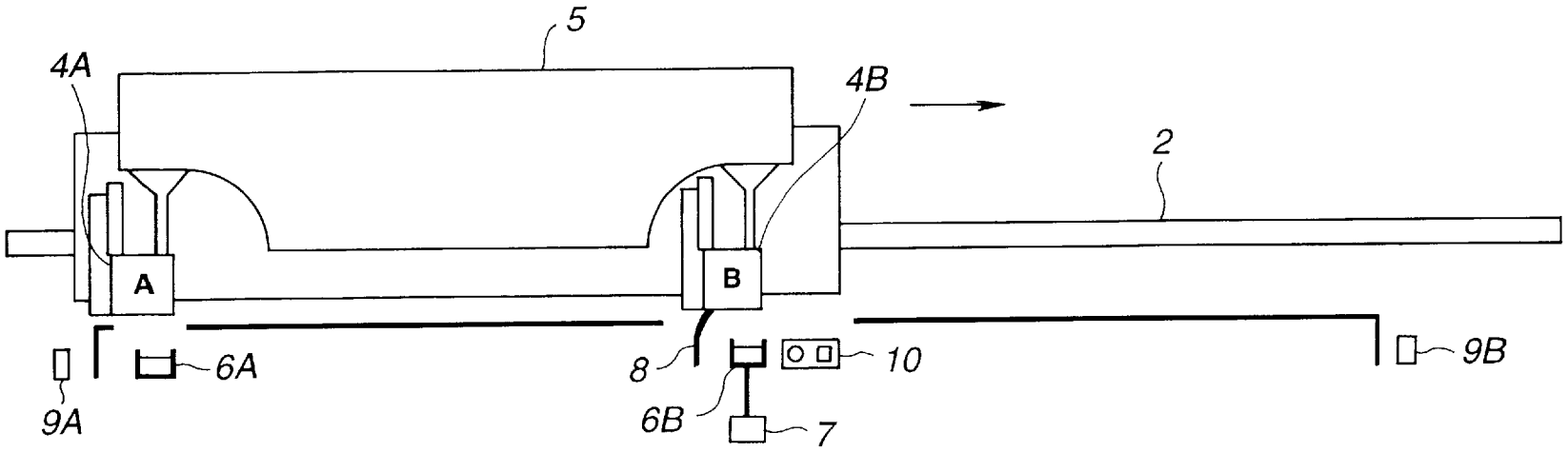
FIGS. 12 and 13 are views similar to that of FIG. 2 but showing the application of a wiper blade to the right and left hand print heads while the carriage is at its left hand and its right hand positions, respectively.
Figure 13:
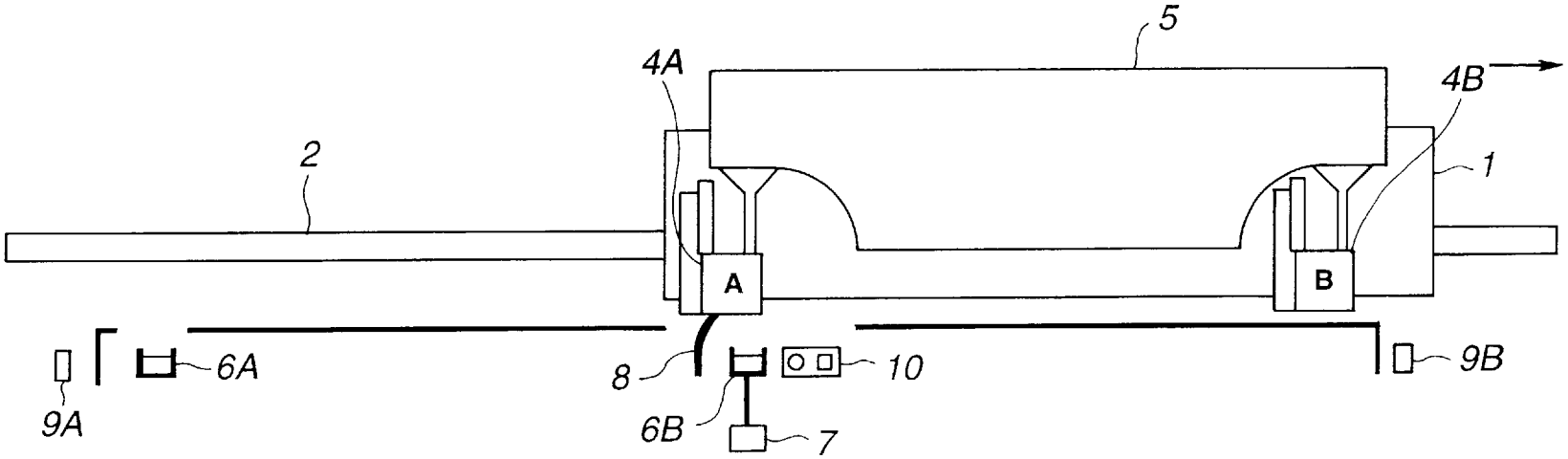

The blade 8, which wipes the discharge openings of the recording heads 4A and 4B constitutes another maintenance apparatus for the recording heads 4A and 4B. Two blades may be provided corresponding to the two recording heads 4A and 4B. However, to simplify the structure, only one blade 8 is provided in the central area of the apparatus; and it acts on the two recording heads 4A and 4B in common. The blade 8 should be provided within the overlapped scanning area of the two recording heads 4A and 4B in the same manner as the cap 6B. However, after the blade 8 is raised to contact one or the other of the recording heads 4A or 4B, as shown in FIGS. 12 and 13, it wipes the face of the head when the carriage moves. Since for the functional reason that the blade 8 is made of an elastic material and is deformed somewhat during its operation, it should be arranged within the overlapped scanning area of the two recording heads 4A and 4B, taking into account this deformation.

The optical ink sensor 10 is provided under the central part of the platen 20 and serves as a monitoring mechanism for the recording heads 4A and 4B in order to detect the presence or absence of ink in the ink tank 5. The ink sensor 10 should be located in a position within an area over which the ink tank passes during scanning. In order to the improve detection precision, the ink tank 5 is provided with two detection portions in the neighborhood of the two recording heads 4A and 4B; and the ink sensor 10 is located in an area over which these two detection portions pass. In other words, the ink sensor 10 is arranged in a central area of the over all scanning area like the cap 6B and the blade 8.

Because the optical ink sensor 10 is located under the platen 20 which supports the recording medium P, the presence of a sheet of the recording medium prevents the sensor 10 from detecting the presence or absence of ink in the tank 5. However, the ink tank construction is such that there is always a sufficient quantity of ink in the ink supply flow path between the tank itself and the discharge nozzles to provide recording for at least one sheet, so that it is sufficient to detect the presence or absence of ink before a new sheet of recording medium is fed to the platen. In addition, by locating the detector 10 in the area over which the recording medium passes, it is possible to obtain information as to the location of the front and back edges of the recording medium as well as the nature of the medium, namely, whether it is plain paper, a film for an overhead projector, etc.

As can be appreciated from the foregoing, the provision of two ink jet recording heads 4A and 4B at both ends of the carriage 1 in the direction of its scan, the scanning distance over which the carriage must move during a recording period can be shortened and the recording speed can be nearly doubled. For the same reason, the life span of the recording heads 4A and 4B also can be doubled. Moreover, since the common ink tank 5 is loaded in the central part of the carriage 1 in this embodiment, the ink carrying capacity in the available carriage scanning space can be raised markedly. Moreover, by virtue of the fact that the carriage can be directly driven, it is possible to improve the carriage feeding accuracy and to simplify the overall structure of the recording apparatus. In addition, by locating the various recording head maintenance apparatus in the common scanning area over which the two recording heads 4A and 4B pass, it is possible with a simple structure to achieve efficiency in the overall operation of the device.

Although the present invention has been described using an ink jet recording system with a color agent carried on a carriage is transferred to a recording medium, the invention is also applicable to other recording devices in which a color agent carried on a carriage is transferred to recording medium. Such other recording devices include, for example, devices which use a heat transfer system, a heat sublimation system, an impact wire dotted system, to transfer the ink from the carriage to the recording medium.

The above described embodiments provide two recording heads 4A and 4B at opposite ends of a carriage to achieve balance and are considered to be the most advantageous. Nevertheless, other structures in which additional recording heads are provided on the carriage, may be employed, although this may cause some increase in the complexity of the device. In one example, three recording heads 4A, 4B and 4C may be provided at equal intervals on the carriage, which is directly driven. When three recording heads 4A, 4B and 4C record over the full recording width PW (206mm) of the recording medium there occur two overlapped recording widths WW (5 mm). In this case, each of the recording heads 4A, 4B and 4C should be provided at head intervals HW of 67 mm on the carriage 1. In other words, the head interval should meet the following relationship:

$$HW=(PW-WW)/3.$$

In this case, the carriage scanning distance for recording is 72 mm; and if the acceleration and deceleration width (UD) is made to be 10 mm on the right and left sides, the overall carriage scanning width SW becomes 92 mm. In this case, it may be difficult to carry out preliminary ink discharge when the recording medium is located in a recording position. However, because of the increased recording speed due to the increased number of recording heads, and because of the above described improvements in recording head maintenance, it is sufficient to carry out preliminary ink discharge either before or after a recording period when there is no recording medium in the recording area. In this case the following relationship should be met:

$$SW=\{(PW+2WW)/3\}+2UD.$$

In the above described device, using three recording heads with a direct carriage drive and a rail positioned in the center of the carriage scanning area, the rail length RL should be not less than the length of the added room AL ( e.g. 2 mm) at right and left sides of the carriage scanning distance SW. Moreover, since the recording heads 4A, 4B and 4C are provided at a head interval HW of 67 mm on the carriage 1, the length of the carriage in the direction of scan CW is longer than the rail length RL, namely 96 mm. Because of this it is possible to obtain a greater area in which to locate the direct drive for the carriage and the linear encoder. In this case, since the carriage scanning distance CSAW is the sum of both the carriage length in the direction of scan and the carriage scanning distance, the scanning distance would have a minimum value of 226 mm. Then, it meets relation of:

$$CSAW=PW+2UD.$$

Accordingly it is only necessary that the space which added to the actual recording width (206 mm) as the acceleration and deceleration width UD, be 10mm at right and left edges. As above mentioned, considering the width of the ink tank 5, this makes it possible to provide a structure which uses a markedly small scanning space. In addition, in this embodiment it is possible to use the entire length of the carriage 1 for the ink tank 5, and thereby greatly increase its ink capacity, along with an increase in recording speed which is more than double, since the scanning distance during the recording period is shortened.

The structure and operation of serial scan type ink jet recording devices, including so-called on-demand and continuous type recording devices, with which the present invention may be used are disclosed in U.S. Pat. Nos. 4,723,129 and 4,740,796. However, the invention is particularly suitable for the on-demand type devices. In those devices at least one driving signal is applied to an electrothermal transducer which acts on a liquid ink retaining sheet or liquid passage. The driving signal is sufficient to produce a sudden temperature rise above the nucleation boiling point of the liquid ink. The thermal energy which produces this temperature rise is provided by an electrothermal transducer. This energy causes film boiling on the heating portion of the recording head, whereby a gas bubble is formed in the liquid ink in response to each of the driving signals. By the production, development and contraction of the gas bubble, a droplet of the liquid ink is ejected through an ejection outlet or nozzle in the recording head. The driving signal is preferably in the form of an electrical pulse. This permits near instantaneous expansion and contraction of the gas bubble so that the liquid ink can be ejected with a quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600. Those patents show the heating portion of the device disposed at a bent portion of the liquid passage. They also show the structure of the ejection nozzle, the liquid passage and the electrothermal transducer used in ink jet recording.

The present invention is also applicable to the structures disclosed in Japanese Laid-Open Patent application No. 123670/1984, wherein a common slit is used as the ejection outlet for plural electrothermal transducers, and in Japanese Laid-Open Patent application No. 138461/1984, wherein an opening for absorbing pressure waves of the thermal energy is formed corresponding to the ejecting portion. This is because the present invention records with certainty and at high efficiency regardless of the type of recording head.

In addition, the present invention is applicable to serial type recording head devices, where the recording head is fixed on the main assembly. It is also applicable to replaceable chip type recording head devices where the head is connected electrically with the main apparatus and can be supplied with the ink when it is mounted in the main assembly. The invention is also applicable to cartridge type recording heads which have integral ink containers.

The ink recovery arrangements and/or the auxiliary means for the preliminary operation as described herein provide special advantages in that they further stabilize the recording operation. Examples of such means include a capping means for the recording head, cleaning means therefore, pressing or sucking means, preliminary heating means, which may be an electrothermal transducer, an additional heating element or a combination thereof. Also, the provision of a preliminary ejection means, in addition to the ejection means used for the recording operation, produces additional stabilization for the recording operation.

As regards the recording head, it may be a single head corresponding to a single color ink, or may be an assembly of several heads corresponding to the several colors or densities of ink used in recording. The present invention is also effectively applied to recording devices which have at least one of: a) a monochromatic mode, for example black; b) a multi-color mode with different color ink materials; and/or c) a full-color mode using a mixture of the colors. Such recording devices may incorporate an integrally formed recording unit or they may use a combination of plural recording heads.

Although liquid ink is used in the foregoing embodiments, ink material may be used which is solid below room temperature but liquid at room temperature. Since the ink is kept within a temperature between 30 and 70 degrees Fahrenheit so that its viscosity will be stable during ejection, the ink may be such that it liquifies at the temperature which the recording signal produces. At least one of these solid ink acts to restrict the rise in temperature by the absorption of thermal energy in undergoing a change in state from solid to liquid. Other ink materials prevent the evaporation of the ink when they are in their solid state. In both cases the ink is liquefied in response to the thermal energy produced by the recording signal so that the ink may be ejected in liquid form. Some of these ink materials may begin to resolidify as they reach the recording material.

The present invention is also applicable to use with ink materials that are retained as a liquid or solid material in through holes or recesses formed in a porous sheet as disclosed in Japanese Laid-Open Patent Application No. 56847/1979 and Japanese Laid-Open Patent Application No. 71260/1985. As disclosed therein, the sheet is positioned to face the electrothermal transducers. The most effective of these techniques employs a film boiling system.

The ink jet recording apparatus of this invention may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

We claim:

1. A recording apparatus for use with plural recording heads, said recording apparatus comprising:

a moveable scanning element which faces toward a recording medium, said moveable scanning element being constructed to support plural recording heads spaced apart in a predetermined interval to record, respectively, on corresponding divided recording areas of an entire recording area, along a scanning direction of the moveable scanning element;

a rail element arranged on said moveable scanning element along its scanning direction, the length of said rail element corresponding to a scanning distance needed for recording over said entire recording area;

a drive element for driving said moveable scanning element via said rail element to cause said moveable scanning element to scan; and a connection portion provided in the region of the central part of a scanning area of said moveable scanning element to couple said drive element and said rail element.

2. An apparatus according to claim 1, further including plural recording heads on said moveable scanning element and spaced apart in said predetermined interval in the direction of scan.

3. An apparatus according to claim 2, wherein said recording heads are removeably mounted on said moveable scanning element.

4. An apparatus according to claim 1, further comprising a marker arranged on said moveable scanning element along its scanning direction, said marker indicating the position of said moveable scanning element; and positional information detecting means provided in the region of the central part of said scanning area of said moveable scanning element for detecting the position of said moveable scanning element.

5. An apparatus according to claim 1, further comprising recording head servicing apparatus for servicing said plural recording heads, said servicing apparatus being located at predetermined locations along a path of movement of said recording heads.

6. An apparatus according to claim 5, wherein said drive element causes said moveable scanning element to scan over a given scanning distance which is longer than said predetermined interval between said recording heads so as to cause the scanning areas of said plural recording heads to overlap each other; and wherein said servicing apparatus is provided within an overlapped scanning area of said plural recording heads so that said servicing apparatus can operate on each of said plural recording heads in common when such recording head comes into position in the overlapped area.

7. An apparatus according to claim 5, wherein said rail element has a length corresponding to a scanning distance needed for both recording and servicing said plural recording heads.

8. An apparatus according to claim 7, wherein said scanning distance of said moveable scanning element is longer than said predetermined interval between said plural recording heads provided on said moveable scanning element so as to cause the scanning areas of said plural recording heads to overlap each other; and wherein said servicing apparatus is provided within an overlapped scanning area of said plural recording heads so that said servicing apparatus can operate said plural recording heads in common when each such recording head comes into position in the overlapped area.

9. An apparatus according to claim 5, and further including plural recording heads on said moveable scanning element and spaced apart in said predetermined interval in the direction of scan, said recording heads each comprising an ink jet recording head which discharges liquid recording ink on the recording medium to record; and said servicing apparatus being constructed and arranged to maintain a discharge condition of said recording head.

10. An apparatus according to claim 2, wherein each of said recording heads is a color agent transfer type recording head which records by transferring a color agent onto a recording medium based on image data according to scanning by said moveable scanning element; and further comprising an agent holding element on said moveable scanning element between said plural recording heads, for supplying such agent to said plural recording heads in common.

11. An apparatus according to claim 10, wherein said recording heads each contain an ink jet recording head which records by discharging liquid record ink as a color agent; and wherein said agent holding element holds liquid recording ink and supplies said liquid recording ink to said plural ink jet recording heads in common.

12. An apparatus according to claim 11, wherein said ink jet recording head discharges ink by using thermal energy.

13. An apparatus according to claim 2, wherein said recording heads record different colors from each other.

14. An apparatus according to claim 1, wherein said recording apparatus is constructed to be used as a terminal for a computer.

15. An apparatus according to claim 1, wherein said recording apparatus is constructed to be used in a copying machine.

16. An apparatus according to claim 1, wherein said recording apparatus is constructe to be used in a facsimile machine.

17. An apparatus according to claim 1, further comprising a transport element for transporting a recording medium onto which the image formed by the recording head is recorded.

18. A recording apparatus for recording an image using a plural recording heads, said recording apparatus comprising:

a moveable scanning element which faces toward a recording medium, said moveable scanning element being constructed to support plural recording heads spaced apart in a predetermined interval to record, respectively, on corresponding divided recording areas of an entire recording area, along a scanning direction of the moveable scnning element;

a rail element arranged on said moveable scanning element along its scanning direction, the length of said rail element corresponding to a scanning distance needed for recording over said entire recording area;

a drive element;

a connection portion arranged to couple said drive element with said rail element to cause said moveable scanning element to scan; and servicing apparatus for servicing plural recording heads supported by said moveable scanning element, wherein said scanning distance of said moveable scanning element is longer than said predetermined interval between said plural recording heads so as to cause the scanning areas of said plural recording heads to overlap each other; and wherein said servicing apparatus is provided within an overlapped scanning area of said plural recording heads so that said servicing apparatus can operate on each of said plural recording heads in common when such recording head comes into position in the overlapped area.

19. An apparatus according to claim 18, further including plural spaced apart recording heads, each of which includes an ink jet recording head which discharges liquid recording ink on the recording medium to record; and wherein said servicing apparatus is constructed and arranged to maintain a discharge condition of said recording heads.

20. An apparatus according to claim 19, wherein said servicing apparatus includes a pump which is constructed and arranged to aspirate ink from said recording heads.

21. An apparatus according to claim 19, wherein said servicing apparatus includes a blade which is arranged to wipe ink discharge surfaces of said recording heads.

22. An apparatus according to claim 18, further including plural spaced apart ink jet recording heads which discharge ink by using thermal energy.

23. An apparatus according to claim 18, further including plural spaced apart ink jet recording heads which record different colors from each other.

24. An apparatus according to claim 18, wherein said recording apparatus is constructed to be used in a terminal for a computer.

25. An apparatus according to claim 18, wherein said recording apparatus is constructed to be used in a copying machine.

26. An apparatus according to claim 18, wherein said recording apparatus is constructed to be used in a facsimile machine.

27. An apparatus according to claim 18, further comprising transport apparatus for transporting a recording medium onto which the image formed by the recording head is recorded.

28. A recording apparatus for recording an image by means of plural recording heads, said recording apparatus comprising:

a moveable scanning element which faces toward a recording medium, said moveable scanning element being constructed to support plural recording heads spaced apart in a predetermined interval to record, respectively, on corresponding divided recording areas of an entire recording area, along a scanning direction of the moveable scanning element and to transfer a color agent on a recording medium located in said area;

a rail element arranged on said moveable scanning element along its scanning direction, the length of said rail element corresponding to a scanning distance needed for recording over said entire recording area;

a drive element for driving said moveable scanning element via said rail element to cause said moveable scanning element to scan;

a connection portion arranged to couple said drive element and said rail element; and a color agent holding element provided on said moveable scanning element between said plural recording heads supplying said color agent to said plural recording heads in common.

29. An apparatus according to claim 28, further including recording heads on said scanning element, said recording heads each comprising an ink jet recording head which records by discharging liquid record ink as a color agent, and wherein said color agent holding element holds liquid record ink and supplies said liquid record ink to said plural ink jet recording heads in common.

30. An apparatus according to claim 28, further including recording heads on said scanning element, and wherein said recording heads each discharges ink by using thermal energy.

31. An apparatus according to claim 28, further including recording heads on said scanning element, and wherein said recording heads record different colors from each other.

32. An apparatus according to claim 28, wherein said recording apparatus is constructed to be used in a terminal for a computer.

33. An apparatus according to claim 28, wherein said recording apparatus is constructe to be used in a copying machine.

34. An apparatus according to claim 28, wherein said recording apparatus is constructed to be used in a facsimile machine.

35. An apparatus according to claim 28, further comprising transport apparatus for transporting a recording medium onto which the image formed by the recording head is recorded.

36. A recording apparatus for recording an image using plural recording heads, said recording apparatus comprising:

a movable scanning element which faces toward a recording medium, said movable scanning element being constructed to support plural recording heads spaced apart in a predetermined interval to record, respectively, on corresponding divided recording areas of an entire recording area, along a scanning direction of the movable scanning element;

an engagement element arranged on said movable scanning element along its scanning direction, the length of said engagement element corresponding to a scanning distance needed for recording over said entire recording area;

a drive element;

a connection portion arranged to couple said drive element with said engagement element to cause said movable scanning element to scan; and servicing apparatus for servicing plural recording heads supported by said movable canning element, wherein said scanning distance of said movable scanning element is longer than said predetermined interval between said plural recording heads so as to cause the scanning areas of said plural recording heads to overlap each other; and wherein said servicing apparatus is provided within an overlapped scanning area of said plural recording heads so that said servicing apparatus can operate on each of said plural recording heads in common when such recording head comes into position in the overlapped area.

37. A recording apparatus for recording an image by means of plural recording heads, said recording apparatus comprising:

a movable scanning element which faces toward a recording medium, said movable scanning element being constructed to support plural recording heads spaced apart in a predetermined interval to record, respectively, on corresponding divided recording areas of an entire recording area, along a scanning direction of the movable scanning element and to transfer a color agent on a recording medium located in said area;

an engagement element arranged on said movable scanning element along its scanning direction, the length of said engagement element corresponding to a scanning distance needed for recording over said entire recording area;

a drive element for driving said movable scanning element via said engagement element to cause said movable scanning element to scan;

a connection portion arranged to couple said drive element and said engagement element; and a color agent holding element provided on said movable scanning element between said plural recording heads supplying said color agent to said plural recording head in common.

* * * * *